US005130014A

United States Patent [19]

Volz

[11] Patent Number: 5,130,014

[45] Date of Patent: Jul. 14, 1992

[54] REMOVABLE SUMP OIL PAN FOR AN INTERNAL COMBUSTION ENGINE

[75] Inventor: Wolfgang Volz, Russelsheim, Fed. Rep. of Germany

[73] Assignee: General Motors Corporation, Detroit, Mich.

[21] Appl. No.: 616,025

[22] Filed: Nov. 21, 1990

[30] Foreign Application Priority Data

Nov. 30, 1989 [DE] Fed. Rep. of Germany ..... 3939567
Apr. 5, 1990 [DE] Fed. Rep. of Germany ..... 4010946

[51] Int. Cl.[5] ..... F01M 11/03

[52] U.S. Cl. ..... 210/130; 210/168; 210/172; 210/188; 210/450; 210/461; 184/1.5; 184/6.24; 184/106; 123/195 C; 123/196 R; 123/196 A; 123/198 E

[58] Field of Search ..... 210/168, 172, 130, 188, 210/436, 450, 461; 123/195 C, 196 R, 198 E, 196 A; 184/1.5, 6.24, 106

[56] References Cited

U.S. PATENT DOCUMENTS 2,754,969 7/1956 Peterson ..... 210/94
3,189,126 6/1965 May ..... 184/106
3,211,256 10/1965 Teutsch ..... 184/106
4,075,099 2/1978 Pelton et al. ..... 210/168
4,667,628 5/1987 Lopez-Crevillen ..... 184/106
4,915,852 4/1990 Tomlinson ..... 184/6.24

FOREIGN PATENT DOCUMENTS 3531352 10/1986 Fed. Rep. of Germany .
8811033 8/1988 Fed. Rep. of Germany .
3830966 5/1989 Fed. Rep. of Germany .
2058599 4/1981 United Kingdom ..... 210/137

*Primary Examiner*—Robert A. Dawson
*Assistant Examiner*—Matthew O. Savage
*Attorney, Agent, or Firm*—Robert J. Outland

[57] ABSTRACT

An oil pan for an internal combustion engine has a relatively flat bottom part as well as a deep pan section as the oil sump with a suction pipe of an oil pump extending into the deep pan section. The deep pan section is designed as a removable oil container. The oil can thus be changed rapidly and without draining the oil since all the oil is collected in the oil container. A cover may be provided to close the container when removed from the shallow flat bottom part. Also, a filter may be mounted in the container and its upper section may be vented to the engine crankcase ventilation system.

9 Claims, 3 Drawing Sheets

REMOVABLE SUMP OIL PAN FOR AN INTERNAL COMBUSTION ENGINE

TECHNICAL FIELD

This invention pertains to an oil pan for an internal combustion engine having a flat bottom part as well as a deep pan section as the oil sump and a suction pipe of an oil pump extending into the deep pan section.

BACKGROUND

Such an oil pan for internal combustion engines is known, for example, from DE 35 31 352 C1. From DE 38 30 966 C1 is also known an oil pan for an internal combustion engine in which a splash container insert, into which a suction pipe of an oil pump extends, is provided adjacent to the bottom of the oil pan. The splash container insert is designed as an essentially single-piece synthetic component, produced separately from the oil pan, with a collar running parallel to the bottom around the outside thereof. The collar is held by means of screws on a bottom section of the pan having an opening for the splash container. The design of the oil pan in the region of the splash container insert serves the purpose of being able to mount said insert simply, but does not serve as a simplification of an oil change.

SUMMARY OF THE INVENTION

The present invention provides an oil pan of the type mentioned having features such that an oil change can be performed rapidly and with a reduced possibility of oil spill or loss.

This result is accomplished in that the deep pan section is designed as a removable oil container.

The volume of the oil container is designed such that said container can contain all the oil used within the internal combustion engine. When the internal combustion engine is inactive, all the oil is collected in the oil container and can be disposed of after removal of the oil container, possibly also together with the oil container. Thus, it is possible to change the oil without draining the oil.

The special design of the oil pan with the oil container makes it possible to design the oil pan as a shallow basin in the region of the flat bottom part. By means of the resulting reduction of the volume of the oil pan, the noise radiation from the internal combustion engine is decreased, the rigidity of the lower region of the engine block is increased, and the production of the oil pan is made easy. The noise radiation from the engine can be optimized by providing an elastic element between the flat bottom part of the oil pan and the oil container.

The oil container is suitably designed as round or angular; in addition, the oil basin may be formed identicially or similarly as far as possible both for a longitudinal mounting and a transverse mounting of the engine and oil pan. It is considered preferable if the oil container is made of sheet metal or a molded synthetic material; however, it is also possible to design it as a metal casting or any other suitable construction.

The oil container can be especially simply mounted or dismounted if it is designed as screw-connected with the flat bottom part of the oil pan. Thus, for example, a connection by means of screws, a screw thread or a snap closure may be used as another known means of connection.

Advantageously, in the region of the flat bottom part, the oil pan connects with the oil container via a transitional opening cross section which is smaller than the internal dimensions of the oil container. By this means, the surface portion of oil exposed in the region of the flat bottom part of the oil pan and the oil container is highly minimized to reduce the inclusion or absorption of air in the oil.

According to a preferred embodiment of the invention, the oil container contains an oil filter. Thus, the oil container serves not only as the collection container for the oil, but the oil is also filtered in the region of the oil sump. By placing the oil filter in a region of a low flow rate of the oil with the possibility of a large filter surface, decisive advantages can be attained compared to known oil filters arranged above the oil sump, especially based on improved depth action and a greater fineness of the pore size. The oil is suctioned out of the clean side of the oil filter via the suction pipe. In this case, the suction pipe suitably feeds in the conventional manner into a bell with a sieve in its lower region. The return flow of the oil takes place via corresponding channels or on the crankcase walls. The entrainment of air into the oil can be kept low or can be reduced by known elements such as oil honeycombs, oil line ribs, oil planes, splash plates or the like. The filter itself is advantageously ring-shaped and the suction pipe with a sieve and bell dips into the ring. However, instead of an oil filter, a sieve can also be arranged in the oil sump.

Thus, the development of the oil pan in accordance with the invention comprises an improvement in the noise radiation of the oil pan, the oil quality, the service when changing the oil including the possibility of recycling old oil and the filter element parts as well as in the oil container with simultaneous overflow prevention and component minimization.

An additional goal of the present invention was to further develop an oil pan of this type in such a way that the undesirable escape of oil into the environment can be reliably prevented when the oil container has been removed. This goal is achieved in an oil pan of the specified type by means of a cover that can close the removed oil container.

The specified design of the oil pan, is an excellent basis for a recycling system based on the exchangeable oil container. Thus, it is basically conceivable that when an oil change must be performed, an oil container filled with fresh oil and closed with the cover replaces the old container with the used oil that is mounted on the car. To accomplish this change of containers, the oil container containing the used oil is removed from the shallow base part of the oil pan; the used oil remains in this oil container, which is then closed with the cover previously used to close the oil container holding the fresh oil. After removal of the cover from the oil container containing the fresh oil this fresh oil container can then be mounted on the shallow base part of the oil pan. The sealed oil container containing the used oil is sent to a recycling system, where the used oil and possibly an oil filter integrated in the oil container are replaced. The cleaned and tested oil container, filled with fresh oil, equipped with a new filter and sealed with a cover are returned to the sealed distribution system.

The sealing cover on the oil container reliably prevents the uncontrolled escape of oil into the environment. The oil container, which is designed as a replaceable container, and the used oil that it contains can be safely processed. Reuse of the oil container and its cover results in savings of raw materials and energy.

The cover is suitably plate-shaped or bell-shaped. The cover is advantageously mounted on the oil container by the same mounting elements that are used to fasten the oil container to the shallow base part of the oil pan. For example, mounting elements, especially screws, can be used which are sealed from and pass through a base part and a cover part of the oil container adjacent to an upper opening in the oil container aligned with a lower opening in the shallow base part; these mounting elements can be connected with the cover (and, especially, screwed into the cover) when the oil container is removed. To reliably seal the oil container from the outside, an elastic sealing element, especially a gasket ring, should be placed between the cover part of the oil container and the cover.

In an especially advantageous embodiment of the invention, the oil container contains an oil filter. The oil filter advantageously has an annular design, and the cover has a rotationally symmetrical attachment on the side facing the oil container, especially a frustum-shaped attachment that tapers away from the cover and that comes to rest against the annular opening of the oil filter facing the cover. The cover can be centered with respect to the filter and thus with respect to the opening of the oil container by means of this rotationally symmetrical attachment.

A preferred modification with respect to the oil filter, which is sealed at the top by a ring cover, provides that the suction pipe is sealed from and passes through the ring cover, and that the gas that collects between the oil filter and the ring cover is discharged by lines into the crankcase breathing system of the internal combustion engine. This discharge into the crankcase breathing system results in improved degassing and in an increase in the amount of filtrate. The resulting vacuum filtration can be used to achieve further quality improvement of the oil and to contribute to a reduction of the component parts of the filter. The vacuum filtration also facilitates the use of alternative filter materials that are safer for the environment, for example, the use of sintered materials. In regard to design, the oil filter should have a radial opening that is connected by a line to an opening in the oil container, which in turn is connected to a line in the shallow base part of the oil pan that leads to a crankcase breathing system. When the oil container is mounted on the shallow base part, the line of the oil container is thus automatically forced into connection with the line leading to the crankcase breathing system. The system itself is suitably adjusted, e.g., by means of a throttle valve in the line. A bypass system should be provided in case the oil filter becomes clogged. The bypass system can be controlled by the level of oil or by pressure. In the latter case, it is convenient for the oil filter to rest on the bottom of the oil container or to be sealed at the bottom, and for a valve to connect the dirty side and the clean side of the oil filter, such that the valve opens on the clean side when a certain underpressure is reached. The opening of the valve can be transmitted as a signal to the dashboard of the vehicle to inform the driver that the oil container and filter should be changed.

Additional characteristics of the invention are described in the description of the figures and in the subclaims.

BRIEF DRAWING DESCRIPTION

In the figures, the invention is represented with reference to a preferred embodiment as an example, without being limited to this embodiment.

FIG. 3 shows a top view of the oil pan;

DETAILED DESCRIPTION

Figure 1:
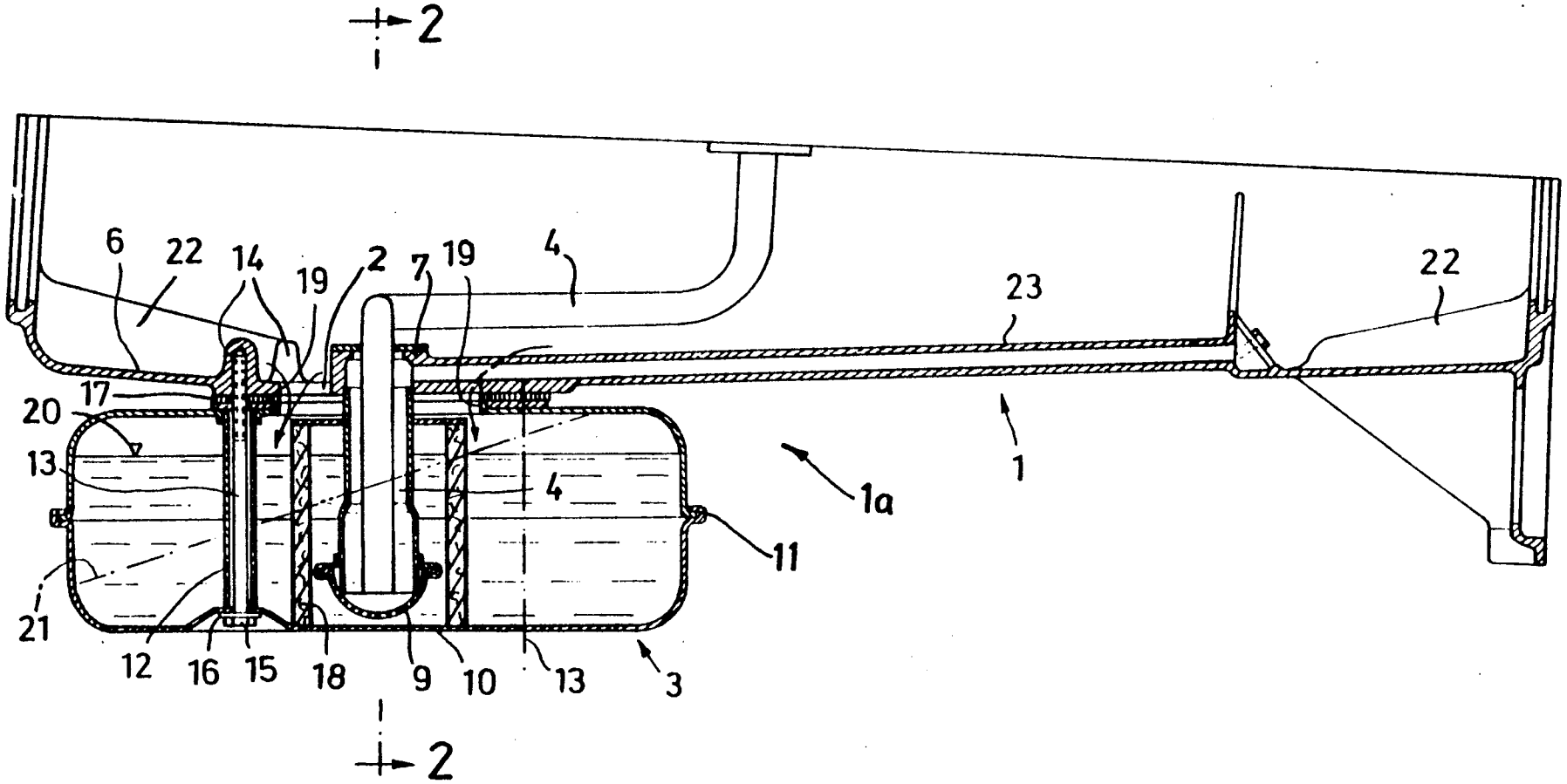
FIG. 1 is a longitudinal cross section through an oil pan in accordance with the invention (according to line 1—1 in FIG. 3)

Referring to the drawings in detail, there is shown an engine (not numbered) having an oil pan generally indicated by numeral 1*a*. The pan 1*a* includes an upper section comprising a relatively shallow oil basin 1 with a bottom opening 2 in the region of which an oil container 3 is connected with the oil basin 1. The oil basin 1 and the oil container 3 together form the oil pan 1*a* of the internal combustion engine (otherwise not shown in detail). The embodiment illustrated is provided for longitudinal mounting of the internal combustion engine in a vehicle. The bottom opening 2 of the oil basin 1 is located toward the front end of the engine and on a slightly lower level than the rear bottom portion of the oil basin 1, such that a natural flow gradient is produced within the oil basin 1 towards the bottom opening 2. A suction pipe 4 connected with an oil pump (not shown in detail) is secured by means of two screws 5 with a bottom segment 7 arranged within the bottom plane 6 of the oil basin 1. The suction pipe is secured through the segment 7 via two crosspieces 8 to the oil basin 1. The suction pipe 4 includes a bell-shaped portion on its lower end which is provided with a sieve 9, that, when the oil container 3 is mounted, is slightly spaced from the oil container bottom 10. The oil container 3 is formed from sheet metal with a pan-shaped container bottom part 3*a* and a container cover part 3*b*, which are sealingly connected to one another in the region of a flange 11.

Referring particularly to FIG. 1, four bushings 12 extend vertically through the oil container. Hexagon cap screws 13 inserted from below through the bushings 12 penetrate, with their threads, screw taps 14 in the bottom 6 of the oil basin 1. Elastic seal rings 16 are disposed between the screw heads 15 of the screws 13 and the recessed portions of the container bottom part 3*a* assigned to them. Also elastic seal rings 17 are disposed between the container cover part 3*b* and the bottom 6 of the oil basin 1. The seal rings 16, 17 are penetrated by the screws 13 in each case and prevent noise conduction between the oil container 3 and the oil basin 1.

A cylindrical ring-shaped oil filter 18 with an elastic ring cover 18*a* is inserted into the oil container 1. The internal diameter of the filter 18 is slightly greater than the outer diameter of the sieve 9 and the outer diameter of the latter is somewhat less than the diameter of the edge 19 of the bottom opening 2. The elastic ring cover 18*a* rests against and internally seals the corresponding section of the suction pipe 4.

It goes without saying that when the oil container is designed with a connection to the crankcase breathing system, the cover should also cover any crankcase vapor line leading out of the oil container. The oil draining in the area of the curved edge 19 of the opening of the oil of basin 1 thus enters the oil container 3 outside of the oil filter 18 and is then filtered as it flows through the oil filter 18 to the suction pipe 4. The oil filter 18 itself can be designed basically like a standard air filter used in motor vehicles.

The oil level when the internal combustion engine is inactive is shown in FIG. 1 with the reference number 20. In this operation state, the oil container 3 is about three-fourths full. The diagonal line assigned with the number 21 illustrates the oil level in the case of a travel pitch of about 30%. The size of the oil container 3 can be variably dimensioned according to the type of vehicle. In the exemplary embodiment, it is seen that at a level according to reference number 20 there is an amount of oil of about 5.5 liters in the oil container and about 4.5 liters in the case of the travel pitch 21.

In the operation of the internal combustion engine, the oil pump (not shown in detail) draws the oil through the oil filter 18 into the suction pipe 4 and from there feeds it to the various lubrication points of the internal combustion engine. By means of the intake of the oil on the filter clean side, not only possible particles, but also air which was entrained in the backflowing oil by the fluid movement in the crankcase housing, are kept away from the oil pump.

From the lubrication points, the oil flows back into the oil basin 1, with the defined oil guidance to the bottom opening 2 of the oil basin 1 being assisted by ribs 22 arranged in the oil basin 1. Components (not shown) also arranged in the region of the oil basin 1 can serve for the separation of air or other gas from the backflowing oil. These elements are preferably oil planes, oil honeycombs or also balls. Moreover, splash plates can be provided to reduce the entrainment of gas. Finally, an open communicating pipe 23, carrying air from the rear region of the oil basin 1 to the suction pipe 4, functions to prevent splashing of the oil during mountain travel.

The oil filter 18 itself can be designed basically like a standard air filter commonly used in motor vehicles. Crosspieces 24 arranged on the upper edge of the oil filter 18 and supported on the lower side of the container cover part **3*b* can also be provided in order to guarantee both a defined portion of the oil filter 18 in its axial direction and a permanently safe installation on the container bottom part 3*a***.

Figure 4:
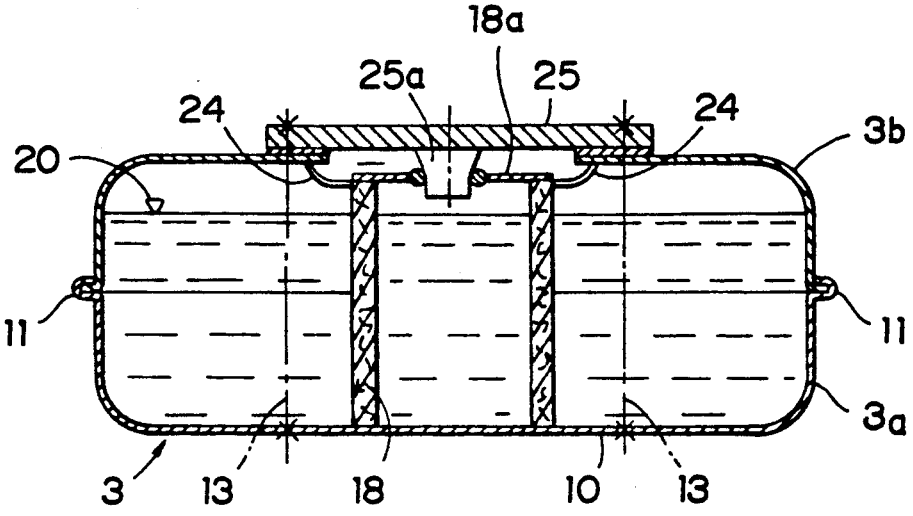
FIG. 4 shows a cross section, as in FIG. 2, through the removed oil container sealed with a cover.

FIG. 4 shows the oil container 3 removed and closed with a flat, platelike cover 25. The oil container 3 was removed by first unscrewing the four screws 13, pulling the lower section of the suction pipe 4 out of the oil filter 18 and then immediately placing the cover 25 over the opening of the oil container 3 and fastening it to the oil container with the four screws. Due to the elastic ring 17 that is already present, when the cover 25 is fastened to the oil container 3, the oil container is tightly sealed to prevent the escape of used oil. The drawing in FIG. 4 does not show details of the type of fastening of the screws 13 with the cover 25; for example, the cover 25 can be provided with threaded holes or with a through hole, so that in the latter case the screws 13 can be screwed into nuts.

The circular platelike cover 25 has a centrally arranged frustum-shaped attachment **25*a* on the side facing the oil container 3. The attachment serves the purpose of centering the cover 25 with respect to the oil filter 18 or the oil container 3. The attachment accomplishes this purpose by lying against the circular inner contour of the elastic ring cover 18*a* when the cover 25 is placed on the oil container 3**.

Figure 2:
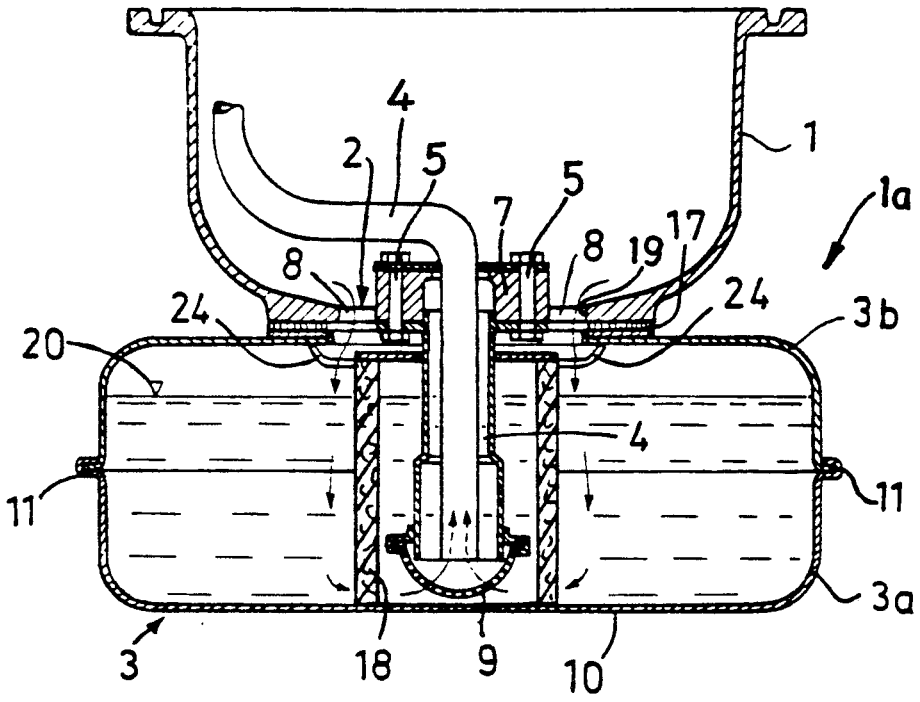
FIG. 2 shows a cross section through the oil pan according to line 2—2 in FIG. 1.
Figure 5:
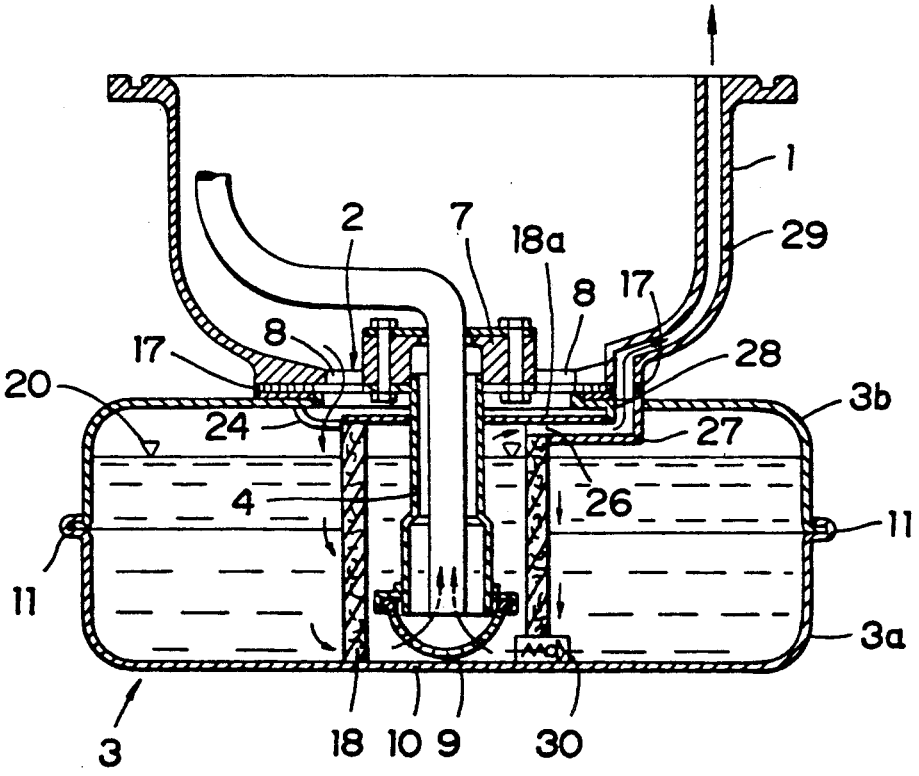
FIG. 5 is a cross section similar to FIG. 2 showing a preferred modification.

FIG. 5 shows a modified design (compared to FIG. 2) of the oil pan with the removable oil container. Parts that are the same as in FIG. 2 are labeled with the same reference numbers for the sake of simplicity. As FIG. 5 shows, the suction pipe 4 passes tightly through the elastic ring cover **18*a* that seals the oil filter 18 at the top. The oil filter 18 has a radial opening 26 adjacent to the elastic ring cover 18*a*. The radial opening 26 is connected by a line 27 to the opening 28 in the cover part 3*b* of the oil container. The opening 28 is connected with a line 29 in the oil tray or basin 1 that leads to the engine crankcase breathing system (not shown). The oil filter 18 rests on the bottom of the oil container 3, and a valve 30 connects the dirty side and the clean side of the oil filter 18. The details of the valve 30 are not shown, but the valve comprises a spring-biased closing element that closes the valve opening towards the dirty side. When the oil filter 18 becomes fouled and its penetrability is thus reduced, increased vacuum develops on the clean side of the oil filter 18. When the predetermined level of vacuum is reached, the valve 30 opens in the direction of the clean side, so that the oil passes by a kind of bypass from the dirty side to the clean side. The opening of the valve 30 can be detected by ordinary means and indicated on the dashboard to alert the driver to the fact that the oil filter container 3, the oil it contains and the oil filter 18 should be changed. After the oil container 3 has been removed and it has been closed by the cover 25, the cover covers not only the central opening 3*a* but also the opening 28**.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine requiring a predetermined volume of a full oil charge, said engine comprising an oil pan including a bottom part forming a shallow basin to collect oil drained from working parts of the engine and an opening in a low portion of the basin to drain from the basin, oil collected therein, an oil container, means for removably mounting said oil container to the bottom part, below and connected with said opening to receive oil drained through the opening, said container defining a sump having an internal volume greater than said predetermined volume of full oil charge for said engine so as to be capable of internally containing such full oil charge, and a suction pipe extending from the bottom part through said opening and into said sump for drawing oil therefrom to lubricate said engine during operation.

2. An oil pan as in claim 1 wherein the container comprises an assembly of sheet material components.

3. An oil pan as in claim 2 wherein the sheet material is metal.

4. An oil pan as in claim 1 wherein the container is mounted to the bottom part by fasteners that extend through the container.

5. An oil pan as in claim 1 wherein the suction pipe has an inlet end and a sieve mounted thereon.

6. An oil pan as in claim 1 wherein the container encloses an oil filter.

7. An oil pan as in claim 6 wherein the oil filter is ring-shaped and the suction pipe extends into the filter.

8. An oil pan as in claim 6 wherein the oil filter has an upper seal ring through which the suction pipe sealingly extends into the oil filter, and vent means in the container and by passing the filter for carrying crankcase gas from under the seal ring within the oil filter to an external crankcase breather system.

9. An oil pan as in claim 6 wherein the oil filter rests on a bottom wall of the oil container and a valve connects inlet and outlet sides of the filter for one-way flow toward the outlet side when a predetermined underpressure is reached.

* * * * *